United States Patent [19]

Wieland

[11] 4,392,428

[45] Jul. 12, 1983

[54] INK FOUNTAIN FOR PRINTING MACHINES

[75] Inventor: Erich G. Wieland, Würzburg, Fed. Rep. of Germany

[73] Assignee: Koenig & Bauer AG, Würzburg, Fed. Rep. of Germany

[21] Appl. No.: 300,852

[22] Filed: Sep. 10, 1981

[30] Foreign Application Priority Data

Sep. 10, 1980 [DE] Fed. Rep. of Germany ..... 3033997

[51] Int. Cl.[3] ..... B41F 31/04; B41L 27/06

[52] U.S. Cl. ..... 101/365; 101/169

[58] Field of Search ..... 101/365, 349, 350, 157, 101/169, 148

[56] References Cited

U.S. PATENT DOCUMENTS 4,040,349 8/1977 Jeschke ..... 101/365

4,058,058 11/1977 Hantscho ..... 101/365

4,170,177 10/1979 Iida ..... 101/169

*Primary Examiner*—J. Reed Fisher

*Attorney, Agent, or Firm*—Jones, Tullar & Cooper

[57] ABSTRACT

An ink fountain for a printing machine is disclosed. A plurality of ink metering elements are placed side by side in a longitudinal gap in the bottom surface of an ink fountain with the gap being parallel to the axis of rotation of the ink roller. Each ink metering element includes an ink guiding surface which terminates in an ink metering extension that is adjustably spaced from the surface of the ink roller. Each of the ink metering elements is rigidly secured to a pivotable arm which extends through an opening in the ink fountain in a direction away from the inner bottom surface of the fountain. Pivoting of the arms causes the ink metering elements to pivot about a pivot line defined by the intersection of the inner bottom surface of the fountain bottom and a first edge of the longitudinal gap. Movement of the ink metering elements changes the space between the fountain roller and the ink metering extension thereby controlling the amount of ink carried out of the fountain by the ink fountain roller.

4 Claims, 2 Drawing Figures

INK FOUNTAIN FOR PRINTING MACHINES

FIELD OF THE INVENTION

The present invention is directed generally to an ink fountain for use in a printing machine. More particularly, the present invention is directed to an ink fountain having a plurality of ink metering elements placed side by side in the ink fountain bottom. Most specifically, the present invention is directed to an ink fountain in which the ink metering elements are each pivotably adjustable about a pivot edge. The ink fountain bottom is provided with a longitudinal gap in which are carried a plurality of laterally placed ink metering elements. These elements are capable of pivotal movement within the gap about a pivot edge formed where a side wall of the gap and the fountain bottom intersect so that the ink metering slot formed between the ink metering elements and an ink roller is adjustable by pivotal movement of the ink metering elements. Each of the ink metering elements is secured to a pivotable arm which is caused to move by a crank arm that is carried in a slot in the arm. All the arms move in a similar fashion to provide a uniform ink metering slot along the length of the ink fountain roller.

DESCRIPTION OF THE PRIOR ART

Ink fountains for printing machines are generally well known in the art. Exemplary of such inking fountains is German Unexamined Published application No. 2,814,889 and corresponding U.S. Pat. No. 4,170,177 to Iida et al. This patent discloses an ink fountain roller which contacts printing ink in a reservoir. The patent further discloses a plurality of ink metering elements which are placed side by side in direct contact with each other. These ink metering elements are placed longitudinally along the axial length of, and spaced from the peripheral surface of, the ink fountain roller. These ink metering elements are pivotably mounted and supported in the ink fountain bottom and are rigidly secured to a pivotable arm. A controllable mechanism is provided to permit adjustment of an ink metering slot formed by the ink metering elements with the surface of the ink fountain roller.

A problem with ink fountains of this type is that the ink guiding surfaces of the ink fountain bottom and of the ink metering elements are always disposed at an angle of just greater than 90° which makes cleaning of the ink fountain quite difficult. A bottom plate of the ink fountain bottom removes printing ink from the ink guiding surfaces of the ink metering elements when the ink metering elements move in the "MORE INK" direction. As the metering elements move in this direction, it is the usual occurrence that ink particles get under the bottom plate. These ink particles can adversely effect the operation of the ink metering elements thereby making the adjustment of the ink metering slot difficult. As a result the slot is not uniform across its length and variations in thickness of the ink applied to the roller result.

SUMMARY OF THE INVENTION

It is an object of the present invention to provide an ink fountain for a printing machine.

Another object of the present invention is to provide an ink fountain having multiple side by side metering elements.

A further object of the present invention is to provide an ink fountain wherein each metering element is carried by a pivotable arm.

Yet another object of the present invention is to provide an ink fountain having an adjustable metering slot.

A still further object of the present invention is to provide an ink fountain having a longitudinal gap in the bottom of the ink fountain with the metering elements being pivotable in the gap.

As will be discussed in greater detail in the description of a preferred embodiment, as set forth hereinafter, the ink fountain in accordance with the present invention is comprised generally of a plurality of ink metering elements which are pivotably carried by spaced pivotable arms. The ink metering elements are placed side by side along the length of the ink roller and spaced from the surface of the roller to form a metering slot. A particular advantage of the present invention is that it permits the formation of an opening angle between the ink guiding surfaces of the ink metering elements and the ink fountain bottom of up to 180° so that the ink fountain can be thoroughly cleaned.

Another particular advantage of the ink fountain in accordance with the present invention is that is substantially reduces movement between the surfaces to be sealed against ink leakage of the ink metering elements and the ink fountain bottom so that ink leakage is substantially eliminated. Furthermore, the relative movement of the ink metering element and the ink fountain bottom does not cause any damage to the sealing means which prevent ink leakage.

BRIEF DESCRIPTION OF THE DRAWINGS

While the novel features of the ink fountain for use in a printing machine in accordance with the present invention are set forth with particularity in the appended claims, a full and complete understanding of the invention may be had by referring to the description of a preferred embodiment as set forth hereinafter and as may be seen in the accompanying drawings in which:

DESCRIPTION OF THE PREFERRED EMBODIMENT

Figure 1:
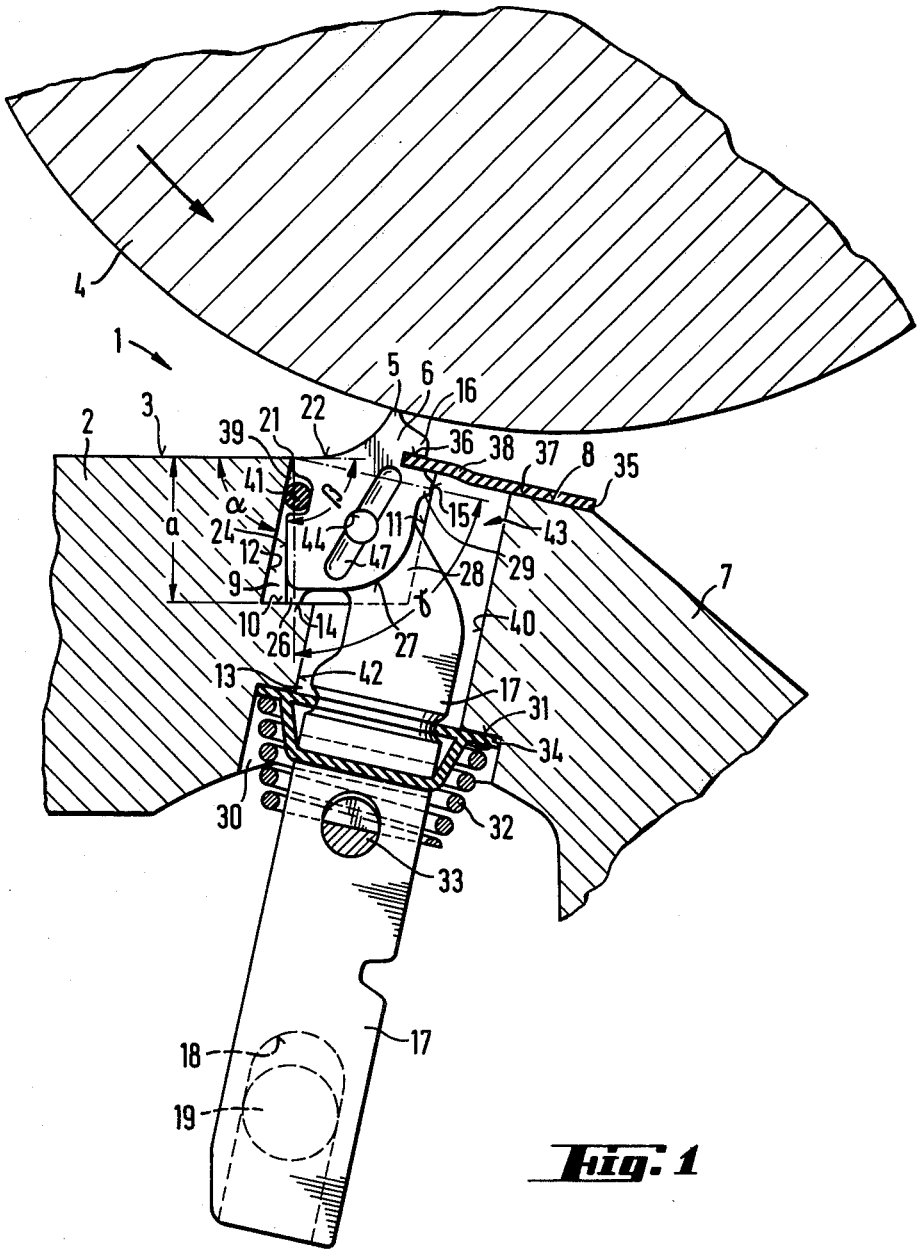
FIG. 1 is a schematic side view of the ink fountain in accordance with the present invention with the ink fountain bottom and ink roller being shown in section and with the lateral end plates removed for clarity.

Turning initially to FIG. 1, there may be seen an ink fountain generally at 1 with an ink fountain bottom member 2 provided therein. An inner bottom surface 3 of ink fountain bottom member 2 is covered with printing ink, when the ink fountain is filled with printing ink. A ceramic-coated ink fountain roller 4, which is driven in a conventional manner, plunges into the ink fountain 1. Ink metering extensions 5 of ink metering elements 6 form a slot with ink fountain roller 4 through which the printing ink passes. The ink fountain bottom 2 extends as an extension of the bottom surface 3 past all of the ink metering elements 6, thus forming a tail piece 7 having a tail face 8. A longitudinal gap 9 is provided in the ink fountain bottom 2, extending down into bottom 2 from the inner bottom surface 3. This longitudinal gap 9 preferably has a rhombus-shaped cross section and extends axially parallel to an axis of rotation of the ink fountain roller 4 near the point of closest proximity of the ink fountain roller 4 to the ink fountain bottom 2. A left guiding surface portion 12 of the longitudinal gap 9 abuts the bottom surface 3 at an angle $\alpha$, which is preferably less than 90°, but which can be as great as 90°. An edge formed by the abutment of the left guiding surface 12 and the bottom surface 3 serves as a pivoting edge or pivoting line 21 for the ink metering elements 6. A right guiding surface 11 extends parallel to the left guiding surface 12 of the longitudinal gap 9, and a base surface 10 of the longitudinal gap 9 extends parallel to, and at a depth "a" below the bottom surface 3, of the ink fountain bottom 2. Vertical openings 13 in the ink fountain bottom 2 end in the base surface 10 of the longitudinal gap 9, these vertical openings 13 being spaced along the entire length "b" of the ink fountain bottom, for example, 30 mm from each other. The cross section of each of the openings 13 is dimensioned so that a pivotable arm 17 which is rigidly secured to each ink metering element 6 that extends horizontally in gap 9, is moveable in opening 13. The pivotable arm 17 can move in a preselectable pivoting motion. It is provided for this purpose with an elongated hole 18 in its lower portion. A crank pin 19 which is driven by an electric motor engages this elongated hole 18. The pivotable arm 17 pivots about the point of intersection 21 of the guiding surface 12 with the bottom surface 3 of the ink fountain bottom 2. The pivoting edge 21 for the pivotable arm 17 is also the pivoting edge for each ink metering element 6 which is rigidly secured to the upper end of a corresponding arm 17. The inner bottom surface 3 of the ink fountain bottom 2 adjoins an ink guiding surface 22 of the ink metering elements 6, so that no groove or ridge which might impede the passage of ink over both surfaces 3 and 22 is formed. Ink guiding surface 22 extends initially in a straight direction, then turns into a concave curvature, which ends in an ink metering extension 5.

A vertical surface 24 of the ink metering element forms an angle $\beta$ of approximately 90° with the ink guiding surface 22 of the ink metering element 6 and ends in a first carrier extension 26. This carrier extension 26 projects downwardly approximately 1 mm below a curved rear surface 27 of the ink metering element 6. A collar 28 at the upper end of the pivotable arm 17 is rigidly and permanently joined to the rear surface 27. The rear surface 27 also includes a second carrier extension 29. The first carrier extension 26 rests upon the base surface 10, whereas the second carrier extension 29 rests upon the right guiding surface 11 of the longitudinal gap 9. The carrier extensions 26, 29 each extend preferably over the entire length "c" of the ink metering element 6 and define an angle $\gamma$ of approximately 80°. The carrier extensions 26, 29 may have a rectangular cross section while their front faces or carrier surfaces 14, 15 should be as narrow as possible. The carrier extensions 26, 29 may, however, be blade-shaped, or they may have a plane front or a curved front.

A borehole 20 is positioned coaxially with each opening 13 and extends into the side opposite the bottom surface 3 of the ink fountain 1. A plane borehole bottom 31 of each extension borehole 30 forms a surface of action for a conical compression spring 32, which is slipped over the pivotable arm 17. This compression spring 32 is held between the borehole bottom 31 and a bolt 33, which projects through the cross section of the pivotable arm 17 and which bolt 33 is rigidly secured to this arm 17. Both carrier extensions 26, 29 and thus the ink metering element 6 are pulled by the compression spring 32 towards the base surface 10 or the right guiding surface 11 of the longitudinal gap 9, respectively.

An elastic sealing membrane 34 which may be, for example, convex, is inserted between the borehole bottom 31 and the compression spring 32. This sealing membrane 34 has an aperture which sealingly engages the pivotable arm 17, sealing it completely. A sealing effect for the ink fountain bottom 2 is secured by pressing the edge of the sealing membrane 34 against the borehole bottom 31 by means of the compression spring 32. A narrow longitudinal groove 36, which extends the whole length "c" of the ink metering elements 6, is provided in a rear part 16 of each of the ink metering elements 6, above the second carrier extension 29, and receives a first lateral edge 38 of an elastic sealing strip 37 to seal the vertical openings 13 from the ink fountain roller 4. A second lateral edge 35 of the elastic sealing strip 37 is secured to the tail surface 8 of the ink fountain 2 thereby sealing this tail surface 8 of the ink fountain 2. The sealing strip 37 extends as a single element over the entire length "b" of the ink fountain bottom 2, and thus over all the ink metering elements 6 of the ink fountain 1, which are disposed side by side.

An axial groove 39 which extends along the entire length "c" of the ink metering elements 6 and parallel to the axis of rotation of ink fountain roller 4 is located in the vertical surface 24 of the ink metering elements 6 approximately 1 mm below the ink guiding surface 22. This groove 39 receives an elastic sealing cord 41 having, for example, a rectangular cross section. This sealing cord 41 extends without breaks over the length "b" of gap 9. It is of a suitable size so that in every operating position of the ink metering elements 6, the left guiding surface 12 of the longitudinal gap 9 is safely sealed to the vertical surface 24 of the ink metering element 6.

Figure 2:
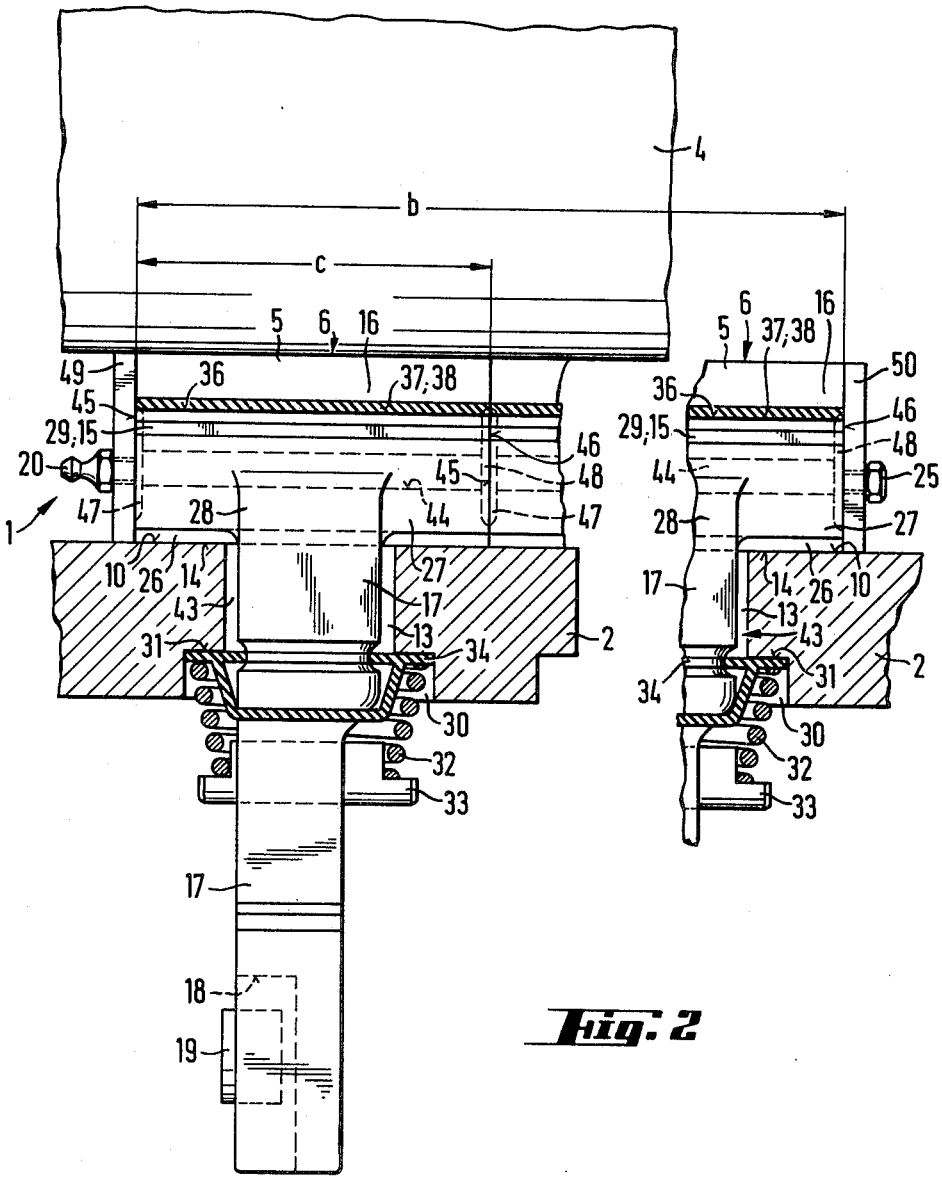
FIG. 2 is a schematic front view of the ink fountain of FIG. 1 with the lateral end plates being shown.

A lubricant chamber 43 which is defined and sealed by the sealing strip 37, a right side face 40 of the opening 13, the sealing membrane 34, a left side face 42 of the opening 13, the base surface 10, the left guiding surface 12, the sealing cord 41, the surfaces 24 and 27 of the ink metering element 6 facing the longitudinal gap 9, and by two lateral end plates 49 and 50, as seen in FIG. 2, extends over the length "b" of the gap 9, and is completely filled with a lubricating means, for example, grease. Printing ink or dirt is thus prevented from penetrating the lubricating means chamber 43 and cannot handicap the operation of the ink metering elements 6.

Each ink metering element 6 is provided with a through borehole 44 in its center. This borehole 44 ends on either front side 45, 46 of ink metering element 6, in a lubricating groove 47, 48 respectively. Every lubricating groove 47, 48 extends within the surface limits of the front sides 45, 46 and is approximately 10 mm long, 2 mm wide, and 0.5 mm deep. A grease nipple 20 is provided on the lateral end plate 49, through which grease can be forced into the boreholes 44 of the ink metering elements 6. An outlet nipple 25, which is capable of being closed and opened, is provided on the second lateral end plate 50, through which waste grease can be forced out. Since all the boreholes 44 of the ink metering elements are in connection with each other, it is possible to press grease through them in a way that the grease is pressed out between the front sides 45, 46 of adjacent ink metering elements 6, and thus dirt and ink pigments which may have accumulated between adjacent elements 6 are simultaneously pressed out.

In operation, the crank pins 19 are all caused to rotate by the electric drive motor (not shown), such motion causing the solid pivot arms 17 to pivot about pivot edge 21 whereby the ink metering elements 6, which are rigidly connected to pivotable arms 17, also pivot about pivot edge or line 21 to adjust the spacing between ink metering extension 5 and ink fountain roller 4. The ink in the ink fountain flows smoothly along the inner bottom surface 3 of ink fountain bottom 2 and along the curving ink guiding surface 22. The lubricating means chamber 43 is sealed by seal 41, by elastic sealing strip 37 and by elastic sealing membrane 34 so that no dirt or ink can get into the longitudinal gap 9. Thus the several ink metering elements 6 which are disposed side by side in gap 9 can operate smoothly and in uniformity to meter the ink applied to roller 4. Similarly, the lubricant which is forced through lubricant hole 44 in each metering element 6 and out through the lubricant grooves 47 and 48 keeps particles of dirt and ink from between end faces 45 and 46 of adjacent ink metering elements 6. Accordingly, the ink fountain in accordance with the present invention includes a plurality of individual ink metering elements which cooperate to uniformly meter ink on an ink roller. Furthermore, the ink fountain in accordance with the present invention allows the ink metering elements to operate smoothly and to remain dirt and ink free.

While an ink fountain for printing machines having means to maintain smooth operation of the ink metering elements in accordance with the present invention has been fully and completely described hereinabove, it will be obvious to one of ordinary skill in the art that a number of changes in, for example, the number of metering elements, the means for pivoting the arms, the securement means for the spring and the like may be made without departing from the true spirit and scope of the invention and that the invention is to be limited only by the following claims.

I claim:

1. An ink fountain for use in printing machines, said ink fountain comprising: an ink fountain roller plunging into said ink fountain; a plurality of ink metering elements provided laterally side by side in an ink fountain bottom of said ink fountain to form an adjustable ink metering slot in cooperation with a peripheral surface of said ink fountain roller; said ink fountain bottom having a longitudinal gap which is axially parallel to said ink fountain roller and having a parallelogram-shaped cross section, a base surface of said longitudinal gap extending parallel to a bottom surface of said ink fountain bottom, a left guiding surface of said gap and said bottom surface forming at their abutting edge a common pivoting edge for said ink metering elements and enclosing an angle less than or equal to 90°; and a right guiding surface in said longitudinal gap; each of said ink metering elements being individually operable, being rigidly secured to a pivotable arm and being capable of pivoting around said pivoting edge; and wherein portions of the periphery of said ink metering elements which are disposed in said longitudinal gap are in contact with said guiding surfaces.

2. An ink fountain according to claim 1, wherein portions of said periphery of said ink metering elements are carrier extensions, a first carrier extension resting upon said base surface, and a second carrier extension resting upon said right guiding surface of said longitudinal gap.

3. An ink fountain according to claim 1, wherein a compression spring freely enclosing each said pivotable arm is provided, a counter bearing for said spring lying on said ink fountain bottom, the point of power application of said spring lying on said pivotable arm.

4. An ink fountain according to claim 1, wherein a sealing means is provided between said left guiding surface of said longitudinal gap and a surface of said ink metering element directly facing said left guiding surface.

* * * * *